United States Patent [19]

Watson

[11] Patent Number: 4,603,532

[45] Date of Patent: Aug. 5, 1986

[54] MODULAR BUILDING CONSTRUCTION

[75] Inventor: John Watson, North Vancouver, Canada

[73] Assignee: Structural Design Services, North Vancouver, Canada

[21] Appl. No.: 795,674

[22] Filed: Nov. 6, 1985

[51] Int. Cl.[4] ..... E04C 2/38; E04B 5/02

[52] U.S. Cl. ..... 52/830; 52/262; 52/263; 52/584

[58] Field of Search ..... 52/263, 262, 827, 580, 52/584, 783, 830, 782, 126.6; 14/73

[56] References Cited

U.S. PATENT DOCUMENTS

| | | | |
|---|---|---|---|
| 490,186 | 1/1893 | Cherest | 52/762 X |
| 868,411 | 10/1907 | Cilek | 52/584 |
| 1,883,141 | 10/1932 | Walthers | 52/630 X |
| 1,967,620 | 7/1934 | Kahn | 52/630 X |
| 1,996,641 | 4/1935 | Coleman | 52/263 |
| 2,009,384 | 7/1935 | Brett | 52/263 X |
| 2,053,135 | 9/1936 | Dalton | 52/828 |
| 2,180,317 | 11/1939 | Davis | 52/226 X |
| 2,190,818 | 2/1940 | Wysong | 52/762 |
| 2,309,451 | 1/1943 | Hasenburger et al. | 52/481 |
| 2,484,283 | 10/1949 | Gilbert et al. | 52/783 X |
| 3,067,843 | 12/1962 | Rushtoh et al. | 52/263 X |
| 3,093,216 | 6/1963 | Dunham | 52/630 X |
| 3,324,614 | 6/1967 | Loewenau | 52/263 X |
| 4,260,293 | 4/1981 | Peterson | 52/263 X |

FOREIGN PATENT DOCUMENTS

| | | | |
|---|---|---|---|
| 2382559 | 11/1978 | France | 52/828 |

*Primary Examiner*—Alfred C. Perham

*Attorney, Agent, or Firm*—Townsend and Townsend

[57] ABSTRACT

A metallic floor panel having top, sides and ends with the sides being longer than or equal in length to the ends. The panel has a flat upper surface. End channels are attached to the upper surface at each end and side channels are attached to the upper surface at each side. The side channels extend further from the upper surface than the end channels. Major ribs, generally parallel to the ends of the panel extend the width of the panel. Minor ribs are arranged between the major ribs and between the major ribs and the end channels. The end channels have lower surfaces generally parallel to the top surface to enable mounting of the panel to a main beam of a building.

3 Claims, 5 Drawing Figures

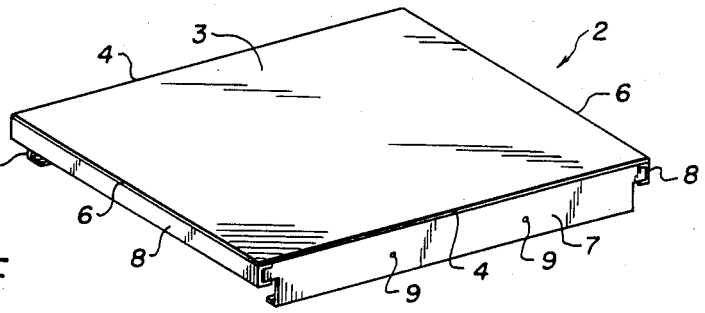
Fig. 1.
Fig. 2.
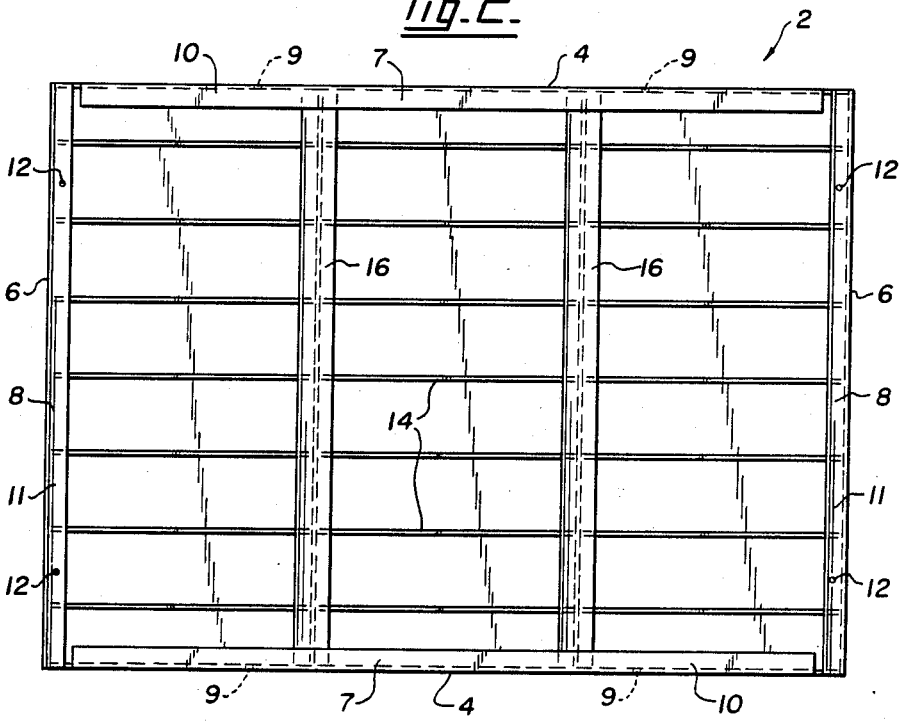

MODULAR BUILDING CONSTRUCTION

FIELD OF THE INVENTION

This invention relates to a metallic floor panel and to a floor constructed from such panels.

DESCRIPTION OF THE PRIOR ART

In conventional steel building construction a plurality of intersecting 'I' beams is provided, to which the floor is attached by bolts, welding or other anchorages.

Where floors consist of thick concrete slabs, these are poured directly onto the steel beams and the supporting formwork. Where floors consist of thin concrete slabs, these are poured onto sheets of profiled steel which act as formwork. Both thick and thin concrete floors provide lateral load distribution to resisting elements.

At this time, plain flat steel sheets are not used as a floor since the thickness of the steel sheet and the closeness of the beams to support it would make the system far too costly.

Also, although partially pre-fabricated floor systems made from concrete are currently used to support the total floor load and act as lateral load-distributing diaphragms, pre-fabricated steel floor systems have not yet been used to combine both functions, i.e. support vertical load and provide lateral load distribution.

Examples of prior art constructions known to applicant include those taught in U.S. Pat. No. 2,309,451 to Hasenburger; U.S. Pat. No. 3,324,614 to Loewenau; U.S. Pat. No. 3,067,843 to Rushton; U.S. Pat. No. 3,093,216 to Dunham; U.S. Pat. No. 2,180,317 to Davis; U.S. Pat. No. 1,883,141 to Walthers; U.S. Pat. No. 1,967,620 to Kahn; U.S. Pat. No. 490,186 to Cherest: and U.S. Pat. No. 2,190,818 to Wysong.

SUMMARY OF THE INVENTION

The present invention seeks to simplify greatly the construction of buildings by using metal panels to form the structural floor and, in particular, to provide a prefabricated metallic floor panel easy to install and easy to construct. Furthermore a floor made using the floor panels of the invention is easy to dismantle and the floor panels may then be reused.

Accordingly the present invention provides a metallic floor panel having top, sides and ends with the sides being longer than or equal in length to the ends, the panel comprising a flat upper surface; end channels attached to the upper surface at each end; side channels attached to the upper surface at each side; the side channels extending further from the upper surface than the ends channels; major ribs, generally parallel to the ends of the panel and extending the width of the panel; minor ribs arranged between the major ribs and between the major ribs and the end channels; the end and side channels having lower surfaces generally parallel to the flat upper surface to enable mounting of the panel to a main beam of a building.

DRAWINGS

Aspects of the invention are illustrated, merely by way of example, in the accompanying drawings in which:

FIG. 1 is a perspective view of a floor panel according to the present invention;

FIG. 2 is a bottom plan view of the panel shown in FIG. 1;

DESCRIPTION OF THE PREFERRED EMBODIMENTS

Figure 3:
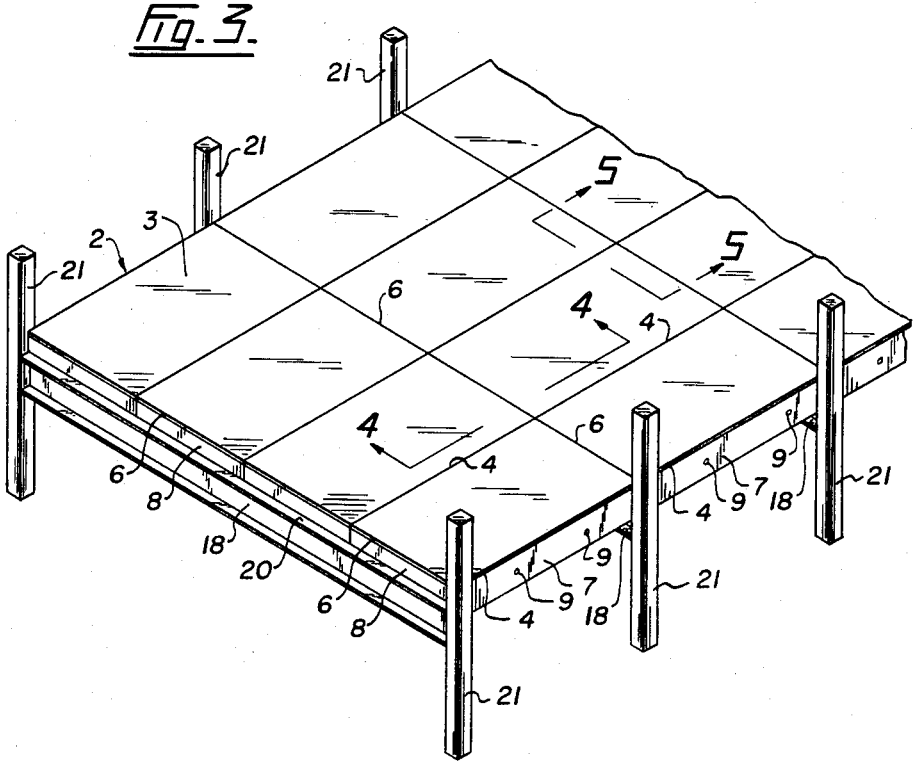
FIG. 3 is a perspective view of part of an elevated floor of a building made using a plurality of panels according to the invention.

The drawings show a prefabricated panel 2 having a flat upper surface 3, sides 4 and ends 6. Sides 4 are longer than or equal in length to the ends 6. There are side channels 7 extending downwardly from the sides 4 of the panel and similar channels 8 extending downwardly from the ends 6 of the panel. The side channels 7 are deeper, that is they extend further from the upper surface 3 than the end channels 8. The side channels 7 and the end channels 8 are, in fact, formed as C-section channels having lower surfaces 10 and 11 respectively as shown in FIG. 2. The side channels 7 and end channels 8 are attached to one-another at the corners of the panel. Holes 12 are formed in the lower surface 11 adjacent each corner of the channels 8. Holes 9 are also formed along the length of the channels 7.

Minor ribs 14 form longitudinal stiffening members and are attached to the underside of panel 2. Major ribs 16 are attached to the underside of panel 2 and extend perpendicularly to members 14. They are provided to increase panel rigidity. The ribs 14 and 16 are rigidly secured to the underside of the upper surface 3, typically by welding. The major ribs 16 are generally parallel to end channels 8, that is across the width of panel 2, and the minor ribs 14 are arranged between the major ribs 16 and between major ribs 16 and end channels 8.

It will be appreciated that although certain cross sectional shapes are illustrated a wide variety of cross sectional shapes are suitable in the major and minor ribs used as stiffening members in the present invention.

Figure 4:
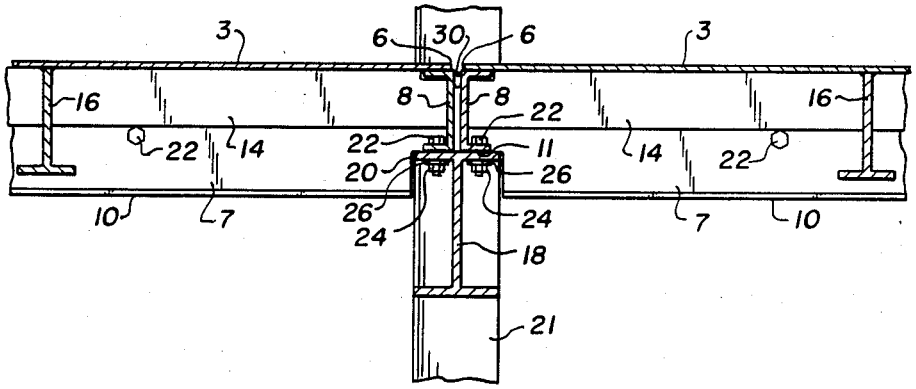
FIG. 4 is a cross section of part of the floor taken along line 4—4 of FIG. 3.
Figure 5:
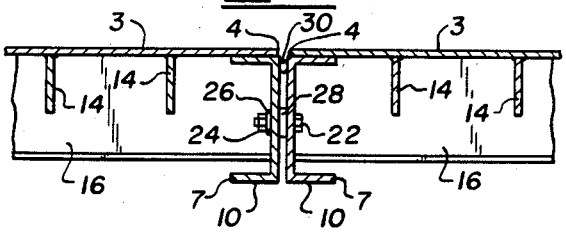
FIG. 5 is a cross section of part of the floor taken along line 5—5 of FIG. 3.

As shown best in FIGS. 3 to 5, to construct a floor using the floor panels of the present invention a panel 2 is placed between two parallel I-beams 18 on a construction site. Lower surface 11 of end channel 8 rests on flange 20 of the I-beam 18. Side channel 7 of panel 2 extends below the flange 20 of I-beam 18 and thus prevents the panel from slipping out of position longitudinally. The I-beams 18 are secured against columns 21 of the building structure. Bolts 22 are placed through holes 12 formed in the lower surface 11 of end channels 8 through suitable drilled holes in I-beam 18 and then secured in place by washer 26 and nut 24. This procedure is repeated for all four corners of the panel 2.

Once this task is completed a second panel is dropped into place beside the first panel and attached to I-beam 18 by end channels 8 in an identical manner by bolts 22, nuts 24 and lock-washers 26. In addition side channels 7 are secured to each other by bolt 22, washer 26 and nut 24—see FIG. 5. A metal spacer 28 is also used as shown in FIG. 5.

Repetition of the preceding step results in the completion of the floor.

To ensure that the floor is leak-proof and water-proof joint filling paste 30 may be employed to fill the spaces between adjacent panels.

Thus the present invention teaches a metallic floor panel and floor produced from those panels that is easy to construct, easily dismantled and in which the panels are reusable after dismantling. A relatively light-weight floor is produced yet capable of sustaining vertical loads in, for example, commercial and industrial load systems with only low deflection. A floor is provided with sufficient lateral stiffness to transmit the horizontal loads of winds and earthquakes to the main structural lateral-load resisting members and the invention also provides an elevated water-proof structural floor of unitary panel construction, with units placed close together enabling sealing against the passage of water.

I claim:

1. A metallic floor panel having top, sides and ends with the sides being longer than or equal in length to the ends, the panel comprising:

a flat upper surface;

end channels attached to the upper surface at each end;

side channels attached to the upper surface at each side;

the side channels extending further from the upper surface than the end channels;

major ribs, generally parallel to the ends of the panel and extending the width of the panel;

minor ribs arranged between the major ribs and between the major ribs and the end channels;

the end channels having lower surfaces generally parallel to the top surface to enable mounting of the panel to a main beam of a building.

2. A panel as claimed in claim 1 in which the end channels are formed with opening in lower surface to enable bolting to a building frame.

3. A panel as claimed in claim 1 in which the side channels have openings in their outer surfaces to permit bolting the panel to a neighbouring panel.

* * * * *